US006338231B1

(12) United States Patent
Enriquez

(10) Patent No.: US 6,338,231 B1
(45) Date of Patent: Jan. 15, 2002

(54) PREFABRICATED CONCRETE WALL PANEL SYSTEM AND METHOD

(75) Inventor: Alberto Enriquez, Chin (MX)

(73) Assignee: Fast Built Panels, Inc., El Paso, TX (US)

( * ) Notice: Subject to any disclaimer, the term of this patent is extended or adjusted under 35 U.S.C. 154(b) by 0 days.

(21) Appl. No.: 09/524,509

(22) Filed: Mar. 13, 2000

(51) Int. Cl.[7] ..... E04C 2/04

(52) U.S. Cl. ..... 52/602; 52/258; 52/259; 52/274; 52/281; 52/283; 52/293.3; 52/309.12; 52/309.17

(58) Field of Search ..... 52/223.6, 258, 52/259, 274, 281, 283, 284, 293.3, 295, 309.12, 309.17, 405.3, 405.4, 320, 414, 602

(56) References Cited

U.S. PATENT DOCUMENTS

| | | | | | |
|---|---|---|---|---|---|
| 1,651,893 | A | * | 12/1927 | Jorgensen | 52/372 |
| 1,834,892 | A | * | 12/1931 | Betzler | 52/284 |
| 1,964,131 | A | * | 6/1934 | Nelson et al. | 52/396.05 |
| 2,058,285 | A | * | 10/1936 | Amescua | 52/262 |
| 2,078,144 | A | * | 4/1937 | Kenan | 52/281 |
| 2,109,265 | A | * | 2/1938 | Foster | 52/438 |
| 2,202,745 | A | * | 5/1940 | Muse | 52/285.2 |
| 2,217,675 | A | * | 10/1940 | Deuel | 52/250 |
| 2,270,846 | A | * | 1/1942 | Hines | 52/223.7 |
| 2,273,775 | A | | 2/1942 | Strong | |
| 2,741,908 | A | * | 4/1956 | Swanson | 52/274 |
| 2,882,712 | A | | 4/1959 | Carlson | |
| 3,334,455 | A | * | 8/1967 | Russell | 52/126.4 |
| 3,435,581 | A | | 4/1969 | Ahlqvist | |
| 4,015,387 | A | | 4/1977 | Tillie | |
| 4,019,293 | A | | 4/1977 | Armas | |
| 4,228,623 | A | | 10/1980 | Menosso | |
| 4,291,513 | A | | 9/1981 | Ankarswed | |
| 4,296,798 | A | | 10/1981 | Schramm | |
| 4,901,491 | A | * | 2/1990 | Phillips | 52/274 |
| 4,909,001 | A | | 3/1990 | Los Monteros | |
| 5,313,753 | A | * | 5/1994 | Sanger | 52/251 |
| 5,950,390 | A | * | 9/1999 | Jones | 52/602 |
| 6,003,278 | A | * | 12/1999 | Weaver et al. | 52/414 |

* cited by examiner

*Primary Examiner*—Beth A. Stephan
*Assistant Examiner*—Brian E. Glessner
(74) *Attorney, Agent, or Firm*—Jacobson Holman, PLLC

(57) ABSTRACT

A precast concrete wall panel and system using such panels, with each panel including a rectangular concrete frame having a flat outer side and a recessed inner side. On the perimeter of the panel and along the face of the recessed inner side, concrete ribs are cast for stiffness. The recessed inner side is embedded with an insulation batt. A strip of wood molding is provided on each inner longitudinal edge of the frame. Using this molding, dry wall may be conveniently fastened to the concrete panel to finish the inside wall surface. To form a wall, the panels are placed side by side. Joints between the panels coincide with reinforcement rods extending upwardly from the building foundation. Recesses in the sides of the panels create channels or keys through which the rods extend. Concrete is poured into the keys to secure the panels to each other and to the foundation. The wall panels are complemented with special components such as corner components, window frames and door frames.

10 Claims, 9 Drawing Sheets

PREFABRICATED CONCRETE WALL PANEL SYSTEM AND METHOD

BACKGROUND OF THE INVENTION

1. Field of the Invention

The present invention generally relates to the field of construction and, more particularly, to a precast concrete wall panel and a wall system using such panels.

2. Description of the Related Art

Modular wall panels and wall systems disclosed in the prior art include the two-slab system of U.S. Pat. No. 2,882,712 to Carlson, the slab-shaped block system with locking rail of U.S. Pat. No. 3,435,581 to Ahlqvist, the prefabricated juxtaposable elements joined with injected settable binder of U.S. Pat. No. 4,015,387 to Tillie, and the prefabricated modular room elements of U.S. Pat. No. 4,228,623 to Menosso. The prior art, however, does not teach a precast unitary concrete wall panel having the structural strength and inside-wall finishing convenience taught by the present invention.

SUMMARY OF THE INVENTION

The present invention is directed to a precast concrete wall panel structure which includes a rectangular concrete frame having a flat side and a recessed side. Preferably, the concrete is reinforced with polypropylene fibers. On the perimeter of the frame and along the face of the recessed side, concrete ribs are cast for stiffness and strength, such as when handling the panel. The recessed side is filled with an insulation batt. A strip of wood molding is provided on each longitudinal edge of the frame on the recessed side. This wood molding provides a convenient attaching means for fastening dry wall to the concrete wall panel structure when finishing the inside wall surface.

The present invention also encompasses a precast concrete wall panel system using the precast concrete wall panels of the present invention. More specifically, a wall is formed by placing the panels vertically in side-by-side relation on a foundation and concrete is then poured into a vertical cavity formed by a recess in the adjacent side edges of the panels to unite them. Vertically extending reinforcement bars have one end embedded in the foundation and are horizontally spaced to coincide with the poured concrete panel joints. The reinforcement bars anchor the panels to the foundation as well as to the roof, and provides rigidity against any horizontal force acting against the wall. The panels are complemented with other precast concrete components including those necessary to form wall corners, window frames and door frames.

In view of the foregoing, one object of the present invention is to provide a precast concrete wall panel having interior-facing wood moldings for easily fastening a vapor barrier and drywall to the inside face of the wall panel.

Another object of the invention is to provide a precast concrete panel embedded with an insulation batt.

A further object of the invention is to provide a wall panel in accordance with the preceding objects having significant strength, being made of concrete reinforced with polypropylene fibers.

A still further object of the invention is to provide a concrete wall panel having concrete ribs for enhanced stiffness and strength, such as during handling.

Still another object of the invention is to provide a concrete wall panel frame having longitudinal recesses on each side face such that, when the frames are placed side by side, channels are formed therebetween to receive reinforcement bars and poured concrete.

It is yet another object of the invention to provide a precast unitary wall panel that is not complex in structure and which can be manufactured at low cost but yet efficiently.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
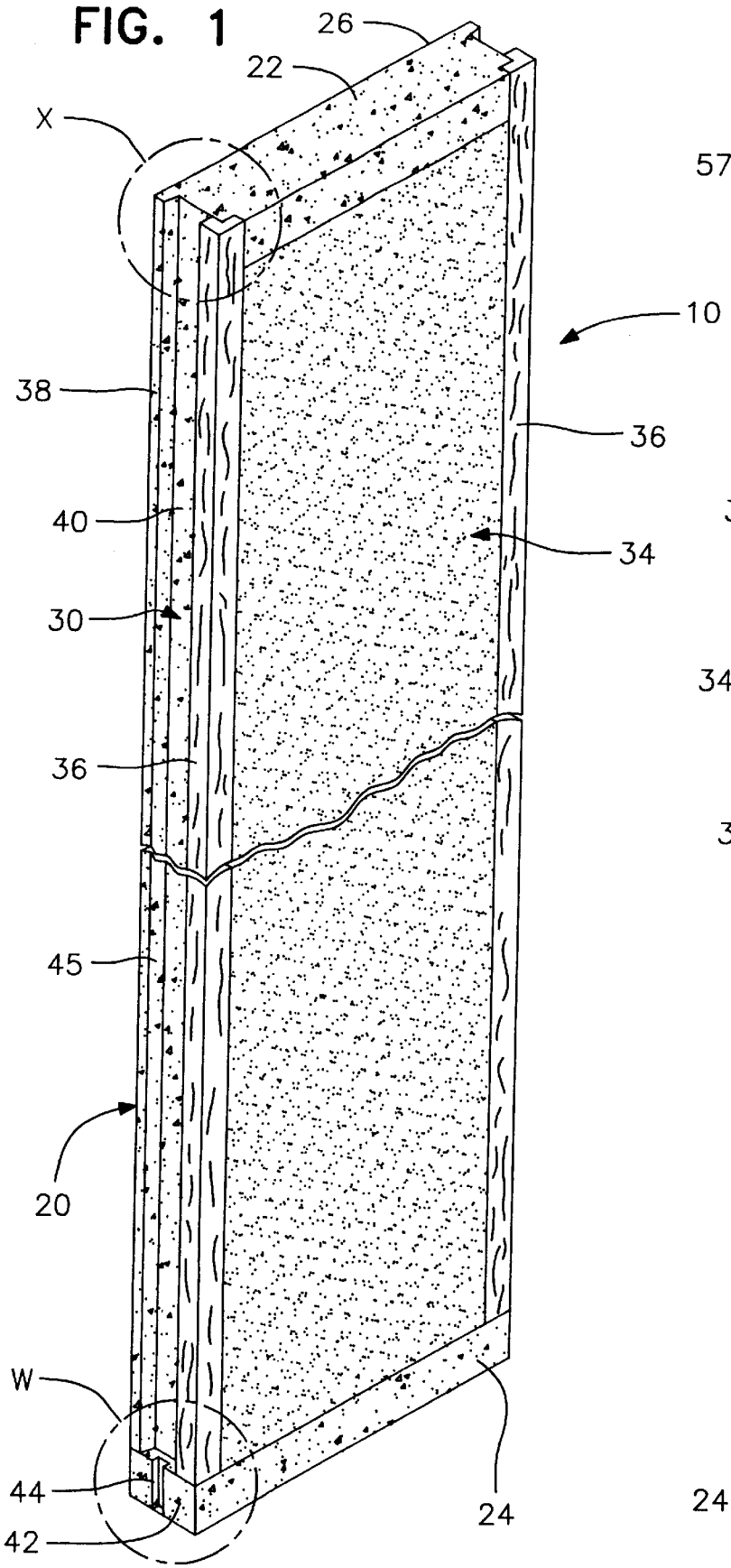
FIG. 1 is a perspective view of a precast unitary concrete panel with insulation batt in accordance with the present invention.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Figure 4:
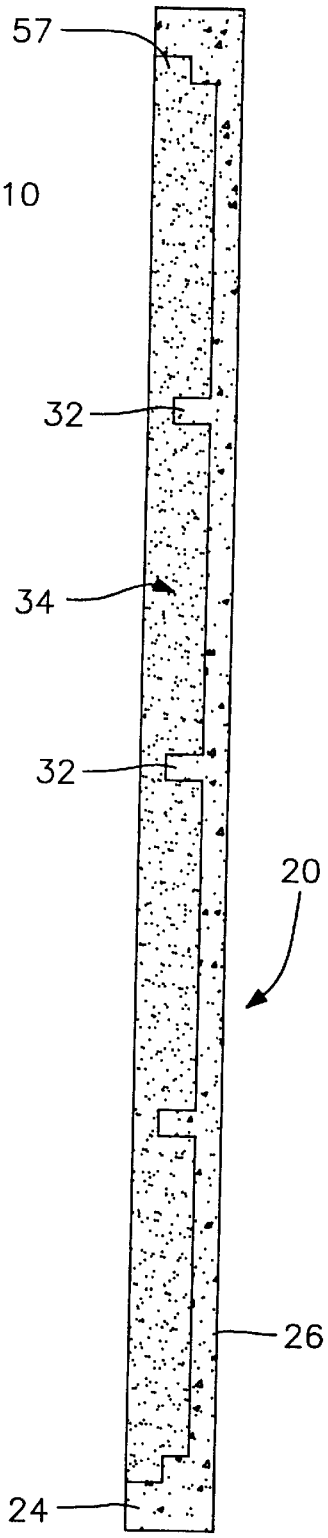
FIG. 4 is an elevational cross-section view along line 4—4 of FIG. 2.
Figure 2:
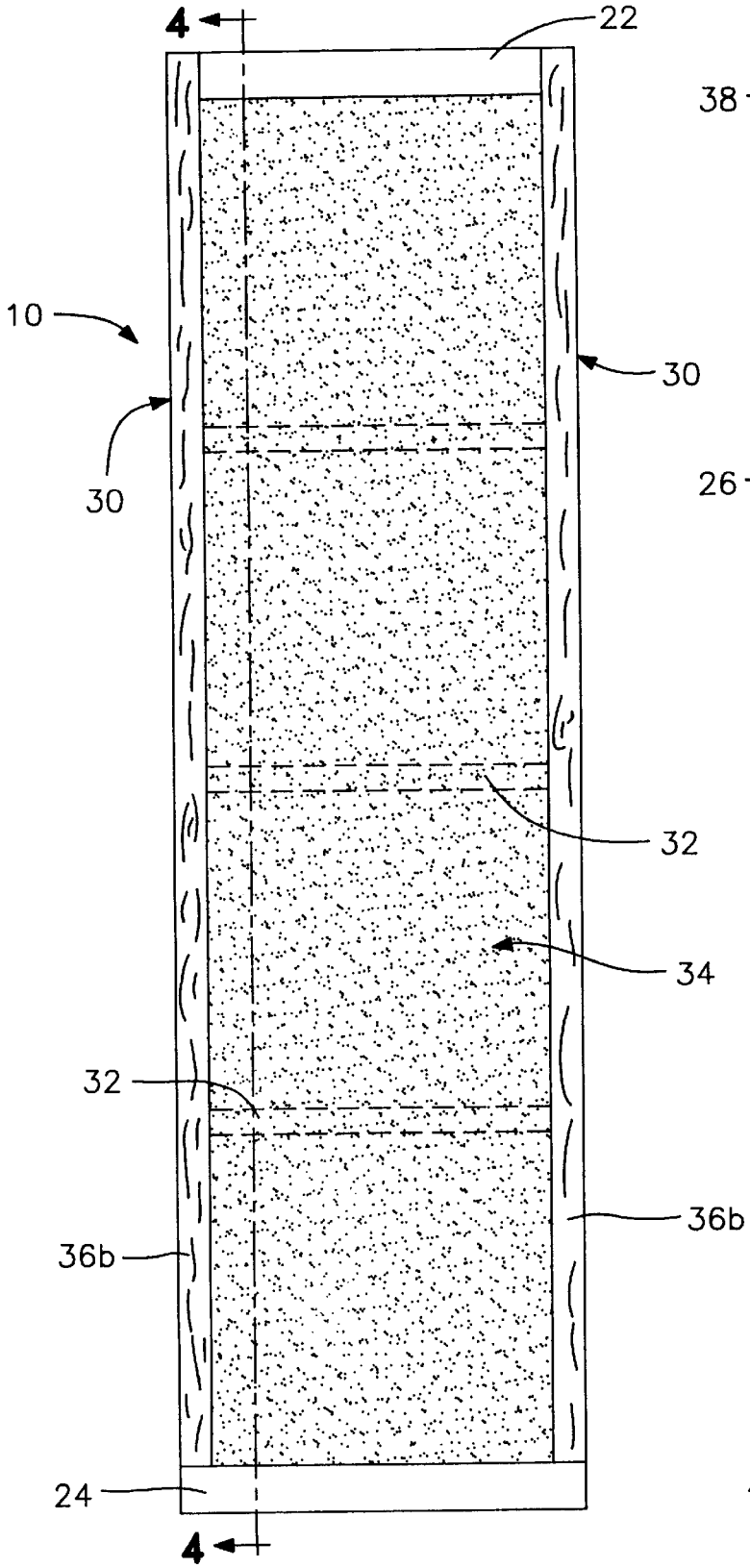
FIG. 2 is a front elevational view of the inner surface of the panel shown in FIG. 1.
Figure 3:
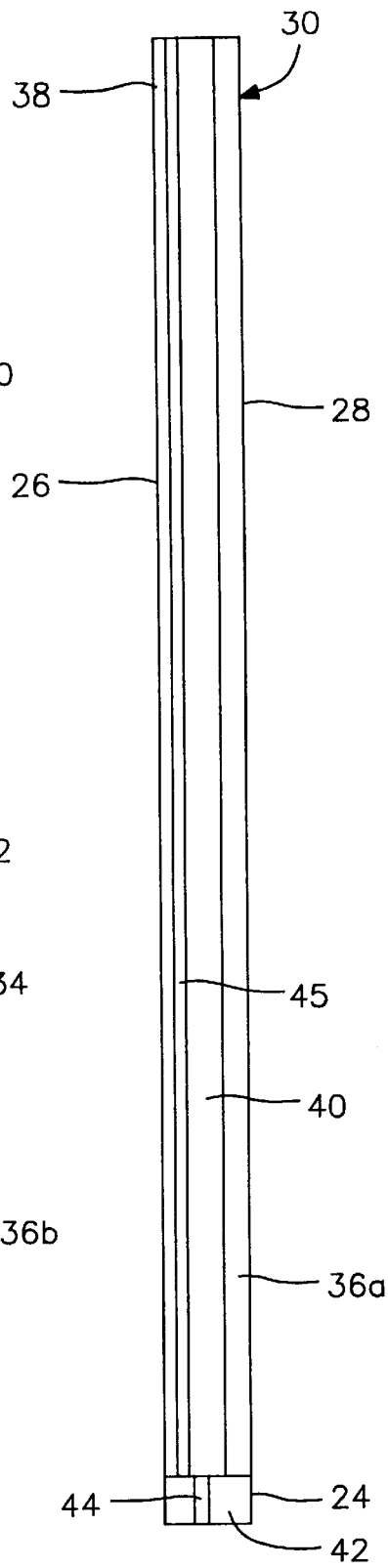
FIG. 3 is a side elevational view of the panel shown in FIG. 1.

Referring now more specifically to the drawings, FIGS. 1 and 2 illustrate the preferred precast concrete wall panel structure, generally designated by the reference numeral 10, of the present invention. FIG. 3 shows a vertical side view of the wall panel structure 10, and FIG. 4 is a vertical section view along line 4—4 of FIG. 2.

The wall panel structure 10 includes an essentially rectangular concrete frame 20 having an upper header 22, a footer 24, a flat outside face 26, a recessed inside face 28, and two side faces generally designated by the reference numeral 30. The recessed inside face 28 includes on its surface a plurality of ribs 32 which preferably extend generally horizontally across panel 10 and are vertically spaced. An eight foot high panel structure 10 typically has three horizontal reinforcing ribs 32. The recess within the inside face is filled with an insulation batt, generally designated by the reference numeral 34.

In the preferred embodiment, the thickness of the frame between the flat outside face 26 and that portion of the recessed inside face 28 from which the ribs 32 extend is approximately one and a half inches. The batt 34 has a thickness of approximately three inches. These thicknesses may be adjusted as necessary or desired to accommodate particular construction requirements.

The frame 20 is constructed with concrete or other cementitious mixture. In the preferred embodiment, the concrete used to construct the frame has a strength of f'c=3000 psi and is reinforced with standard polypropylene fibers. The polypropylene fibers prevent cracks during the settling of the concrete when poured. Materials other than polypropylene fiber, e.g., wire mesh, may additionally or alternatively be used to reinforce the concrete, as would be known to persons of skill in the art.

The wall panel structure 10 includes wood molding 36 along the longitudinal edges on both sides of the recessed inside face 28. The wood molding 36 has an exposed side face 36*a* and an exposed front face 36*b*. The lower ends of the wood molding 36 preferably rest upon the footer 24. The flat outside face 26 of the concrete frame 20 has longitudinal edges 38 which extend laterally to be roughly flush with the exposed side face 36*a* of the wood molding 36, leaving a side edge recess 40, running longitudinally, in the center area of each side face 30 of the frame 20. In addition to forming the side edge recess 40 with the wood moldings 36, the concrete longitudinal edges 38 act as reinforcement ribs along the side perimeters of the frame 20 for increased strength and stiffness.

Figure 5:
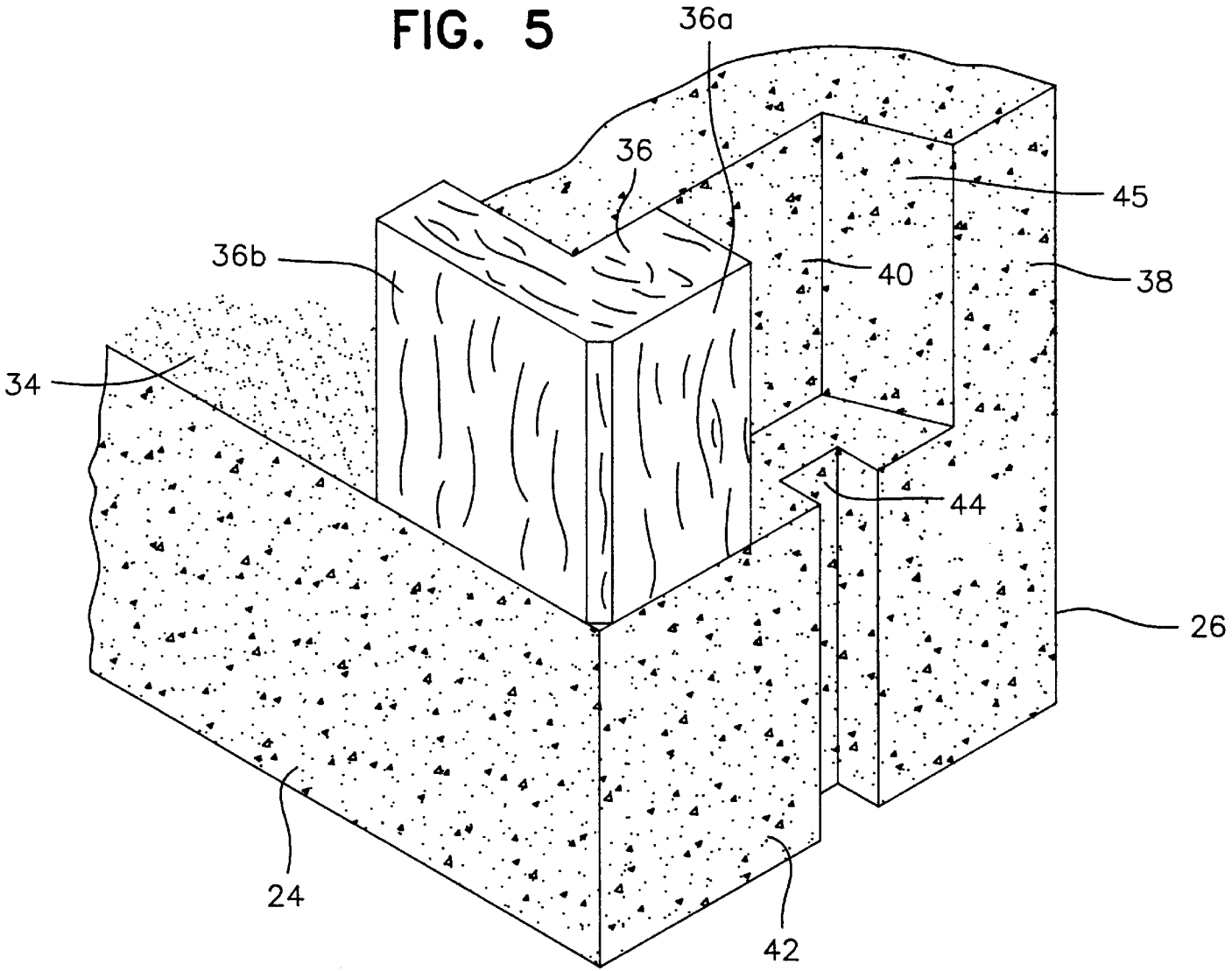
FIG. 5 is an enlarged view of area W showing the details of a lower corner of the panel shown in FIG. 1.

The footer 24 of the concrete frame 20 also has a side face 42 which includes a further recess 44 to accommodate reinforcement rods or bars, i.e., rebar, or other structural members used to secure the wall panel in place on a foundation. FIG. 5 illustrates an enlarged view of the lower end portion of the frame 20 including footer 24. As shown, the wood molding 36 rests upon the top of the footer 24. The footer 24 includes side face 42 with recess 44. The longitudinal recess 40 in the side face 30 of the frame 20 is vertically aligned with the recess 44. It will also be seen that longitudinal edge 38 has a tapered surface 45 opposite flat outside face 26 which facilitates formation of the edge 38 and removal from the forming mold.

Figure 6:
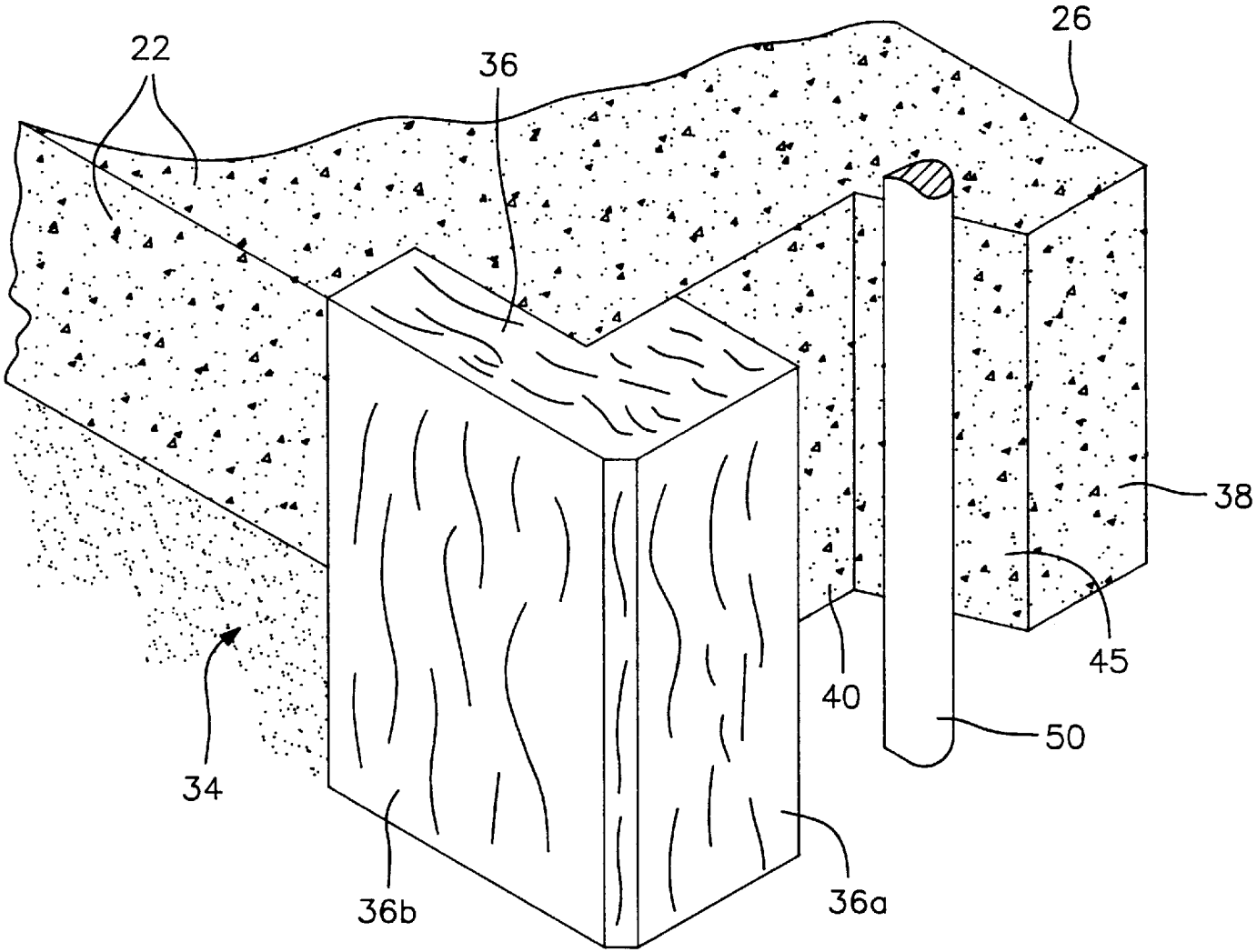
FIG. 6 is an enlarged view of area X showing the details of an upper corner of the panel shown in FIG. 1, together with reinforcement bar positioned in accordance with the present invention.

FIG. 6 illustrates an enlarged view of the upper end portion of the frame 20 including header 22. As shown, the wood molding 36 is secured to the recessed inside face 28 of the frame 20. The longitudinal recess 40 in the side face 30 of the frame 20 accommodates rebar 50 which extends vertically from the foundation, through the recess 44 in the footer 24. The rebar may extend through only part of the vertical height of the wall panel or may extend upwardly beyond the upper header 22, depending on building requirements.

Figure 7:
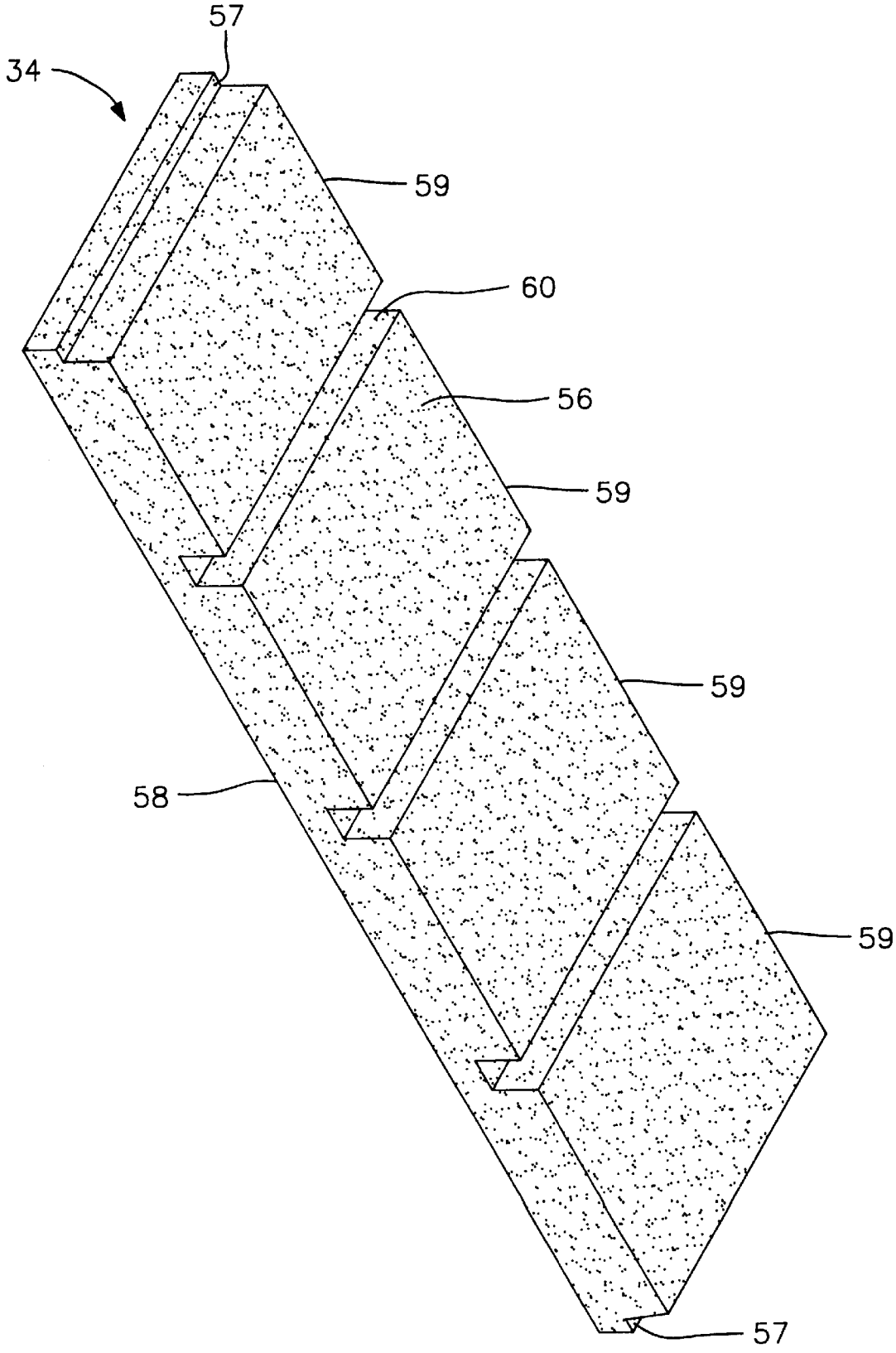
FIG. 7 is a rear perspective view of the preferred insulation batt of FIG. 1 showing the cutouts which form the reinforcing ribs of the concrete panel.

The insulation batt 34 is shown in FIG. 7. As shown, the insulation batt 34 is preferably comprised of four small batts 59, each of approximately the same size and shape. Each batt 59 has a lip 57 on two planar longitudinal edges. When the batts 59 are stacked one upon another, the lips 57 of adjacent batts abut, creating a channel 60 between each pair of adjoining batts 59. When the frame is cast around the insulation batt 34, the channels 60 serve to form the ribs 32 on the recessed inside face 28 of the frame. While the use of four small bats 59 make the insulation batt 34 easier to handle and to set in place during fabrication of the panel, the insulation batt 34 could have a unitary construction or be comprised of different numbers of smaller batts.

The insulation batt 34 has an inner face 56 which is in contact with the recessed inside face 28 of concrete frame 20, and an outer face 58 which is generally flush with the front surfaces of the wood molding strips 36 (see FIGS. 1 and 4). In addition to providing insulation properties to the wall panel structure 10, the insulation batt 34 operates as an inner mold for defining the recessed inside face 28 of the concrete frame 20, as well as inside surfaces for the side faces 30, the upper header 22, and the footer 24 of the frame 20. Once the panel is cast, the batt operates as a "lost" mold, being contained within the frame and molding. Integration of the wood, concrete and insulation components of the panel into a unitary structure may therefore be accomplished in a single operation.

In the preferred embodiment, the insulation batt is made of mineral wool and is approximately three inches thick. As would be known by one of skill in the art, this choice of material and thickness may vary in accordance with necessary or desired final frame construction characteristics.

Figure 8:
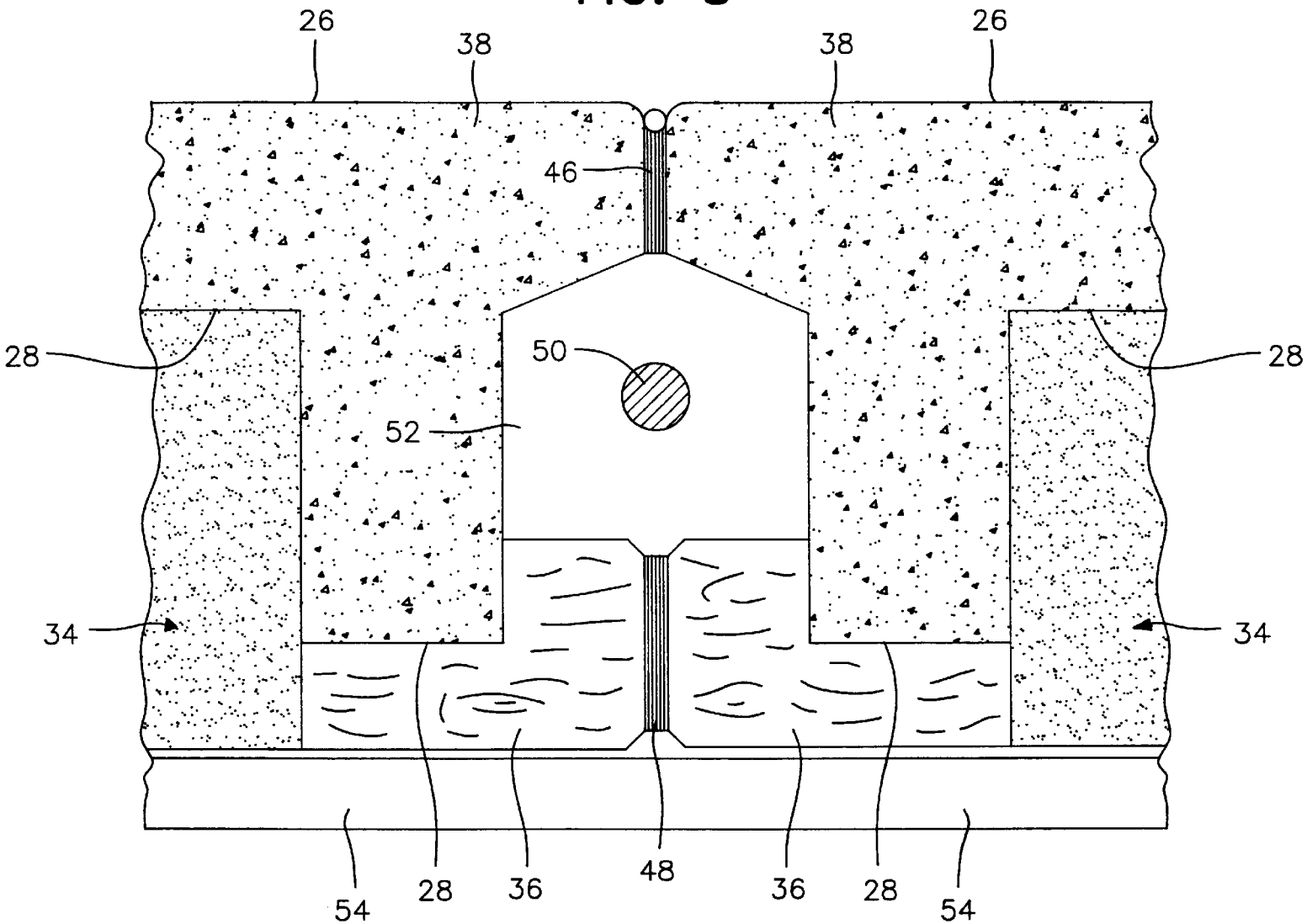
FIG. 8 is a cross-sectional view showing two panels joined in side-by-side relation for forming a wall in accordance with the present invention.

The wall panels 10 are joined together as shown in FIG. 8. The longitudinal edges 38 of the flat outside faces 26 of adjoining wall panel structures 10 abut one another to create an outside joint 46. Silicon or other sealing material is preferably used to fill the outside joint 46. The strips of wood molding 36 along the longitudinal edges of recessed inside faces 28 of the two adjoining panels 10 also abut one another on their exposed side faces 36*a* to create an inside joint 48. In the preferred embodiment, cork is used to effectively fill and seal the inside joint 48.

During construction of a concrete foundation upon which the panels of the present invention are to be mounted, boards of an appropriate size, such as a 2×4, are embedded in the top surface of the foundation. The reinforcement rods or bars 50, often called rebar, are also embedded in the concrete of the building foundation in those places where the panel joints 46, 48 will be located. When the boards, e.g., 2×4's, are later removed, a recessed area is created. This recessed area provides a place to set the lower end of a panel 10 of the present invention when locating the panel 10 on the concrete foundation. The recess also prevents rain water from penetrating underneath the panels and into the house. The plumb of the wall is established and maintained by means of wall braces in the conventional way. Once the panels 10 have been set and joined upon the foundation in the manner shown in FIG. 8, a hollow channel or key 52 is formed by the side edge recesses 40 of the adjoining concrete frames 20. Cement mortar is then poured into the key 52 to prevent movement of the adjoining frames. The cement-filled keys 52 with reinforcement rods 50 embedded therein make the wall monolithic, anchoring the wall to the foundation and providing rigidity against any horizontal force acting against the wall. The reinforcement bars 50 may additionally extend upward to anchor the wall to the roof as well. The front faces 36*b* of the wood moldings 36 then provide a convenient and effective attaching means for fastening a vapor barrier (not shown) and any type of drywall 54 to the wall panel 10 to create an attractive inside finish.

Figure 9:
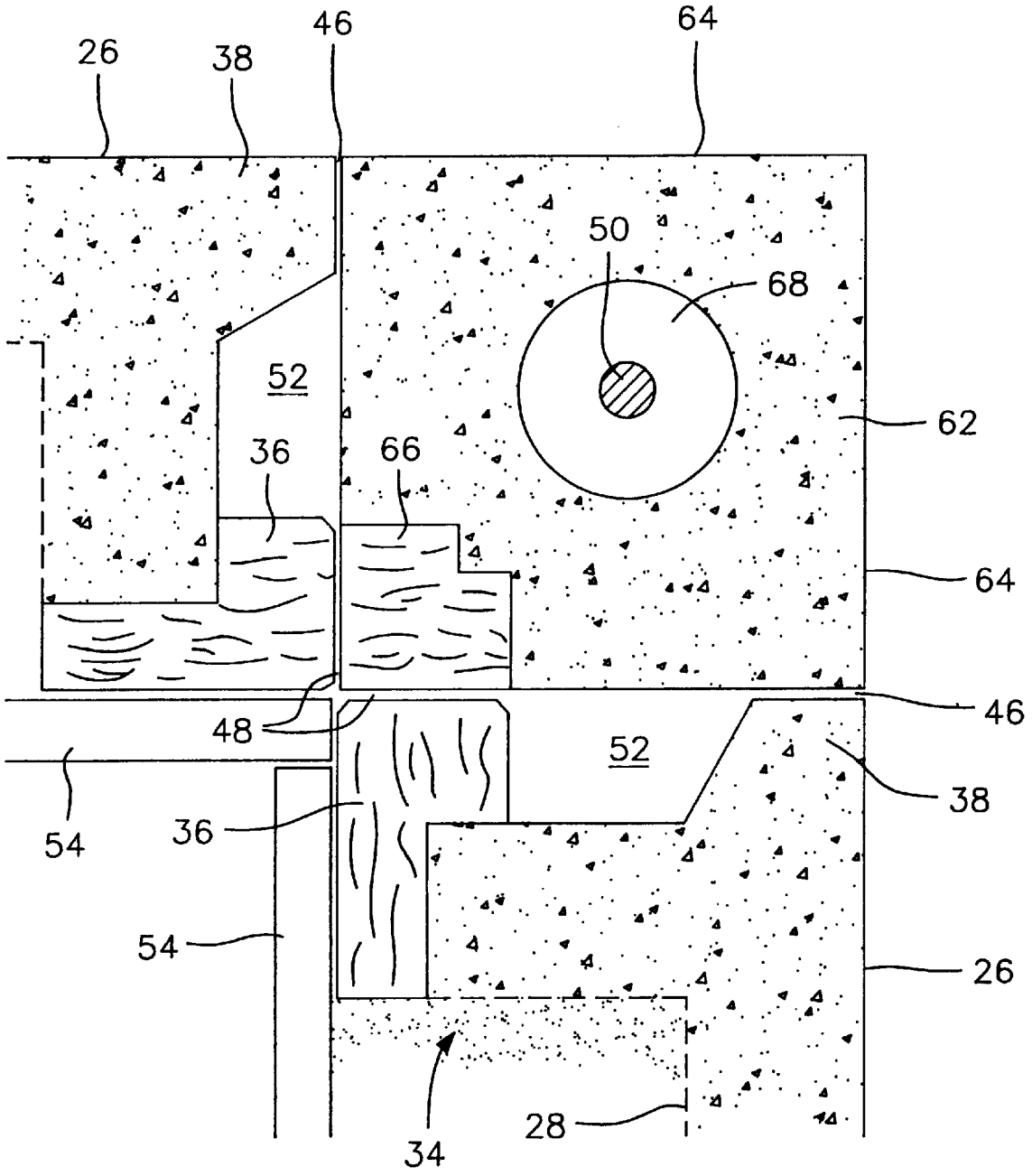
FIG. 9 is a top view of a corner component joined with two wall panels in a first assembly according to the present invention.

The wall panel of the present invention as has been described is complemented with other components such as corners, door frames, window frames, etc. FIG. 9 is a top view of a corner component 62 abutting the longitudinal edges 38 of two wall panels at outside joints 46. Corner components 62 are approximately square in cross section, having a depth and a width that correspond to a depth of the wall panels. Each corner component 62 is constructed of precast concrete and has a longitudinal channel 68 generally in the center thereof, and preferably circular, which runs the height of the component 62, through which rebar 50 may extend. Although not shown, corner components may be constructed by stacking and/or arranging suitably shaped blocks adjacent one another to the desired dimensions. Alternatively, each corner component may be constructed from two full-length halves, each having a semi-circular recess which, when placed adjacent another half, forms the longitudinal channel 68; the halves are then joined by pouring concrete to fill the longitudinal channel 68. The corner components may also be constructed in full-length quarters, or other divisions, constructed to form a longitudinal channel 68 when joined together.

The corner component 62 as shown in FIG. 9 has two outer wall surfaces 64. A wood molding 66 is recessed into one corner of the corner component 62 and abuts the wood molding 36 of each wall panel at joints 48. Channel 68 and keys 52 formed between the corner component 62 and the wall panels are filled with cement mortar to form a rigid corner when the cement mortar hardens. Drywall panels 54 then can be conveniently mounted on wood moldings 36, with or without a vapor barrier, by conventional means such as nails or staples.

Figure 10:
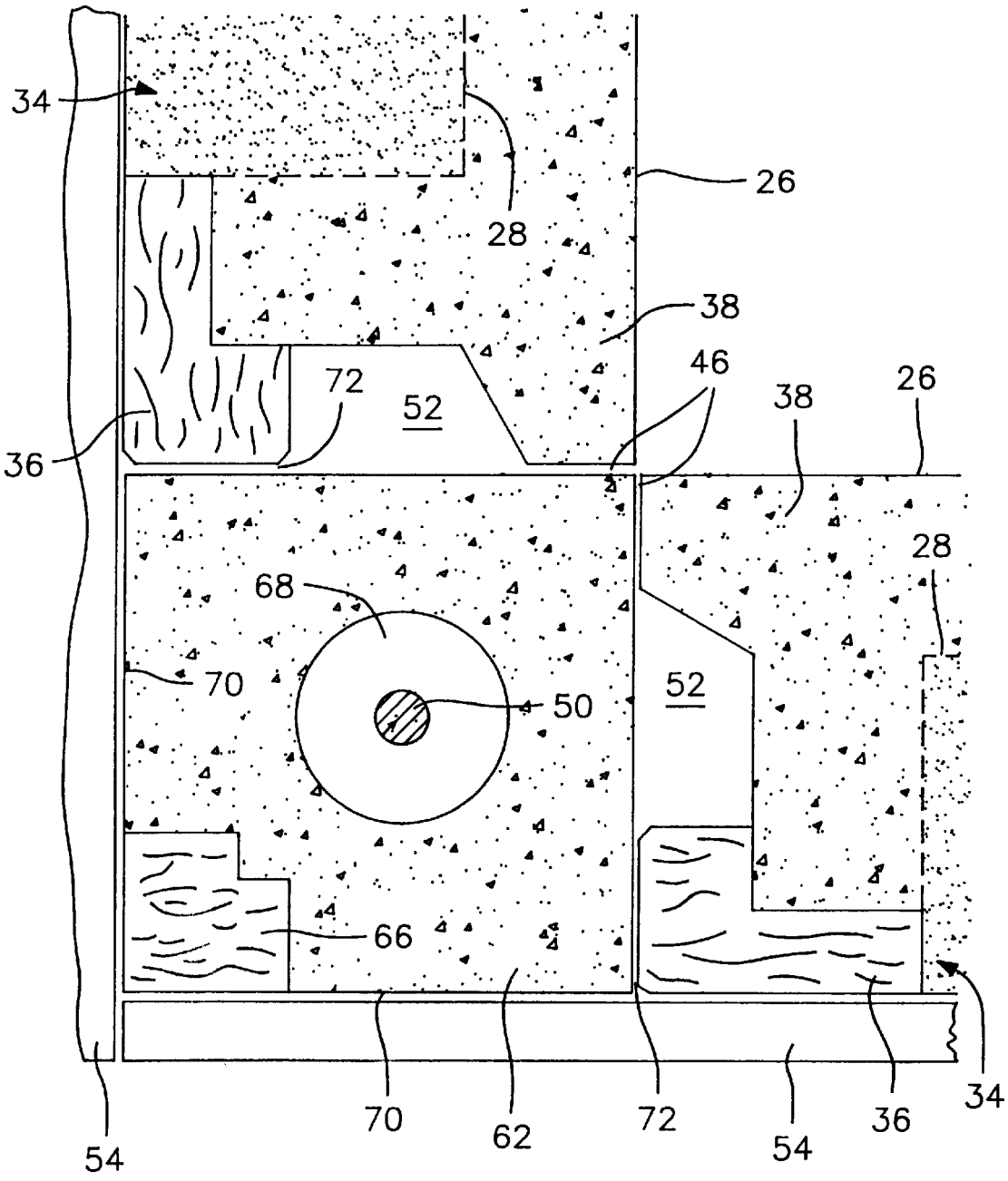
FIG. 10 is a top view of the corner component of FIG. 9, joined with two wall panels in a second assembly according to the present invention.

FIG. 10 is a top view of corner component 62 joined with two wall panels in a second assembly. As shown, the corner component 62 has two wall surfaces 70 flush with molding 66. The longitudinal edges 38 of the two wall panels 10 join corner component 62 at joints 46. The wood molding 66 of the corner component 62 is used to attach the drywall 54 to the corner component 62. The wood molding 36 of the wall panels also supports the dry wall 54 and abuts the corner component 62 at joints 72. Keys 52 formed between the corner component 62 and the wall panels 10, as well as the longitudinal channel 68, are filled with hardenable cement mortar.

Figure 11:
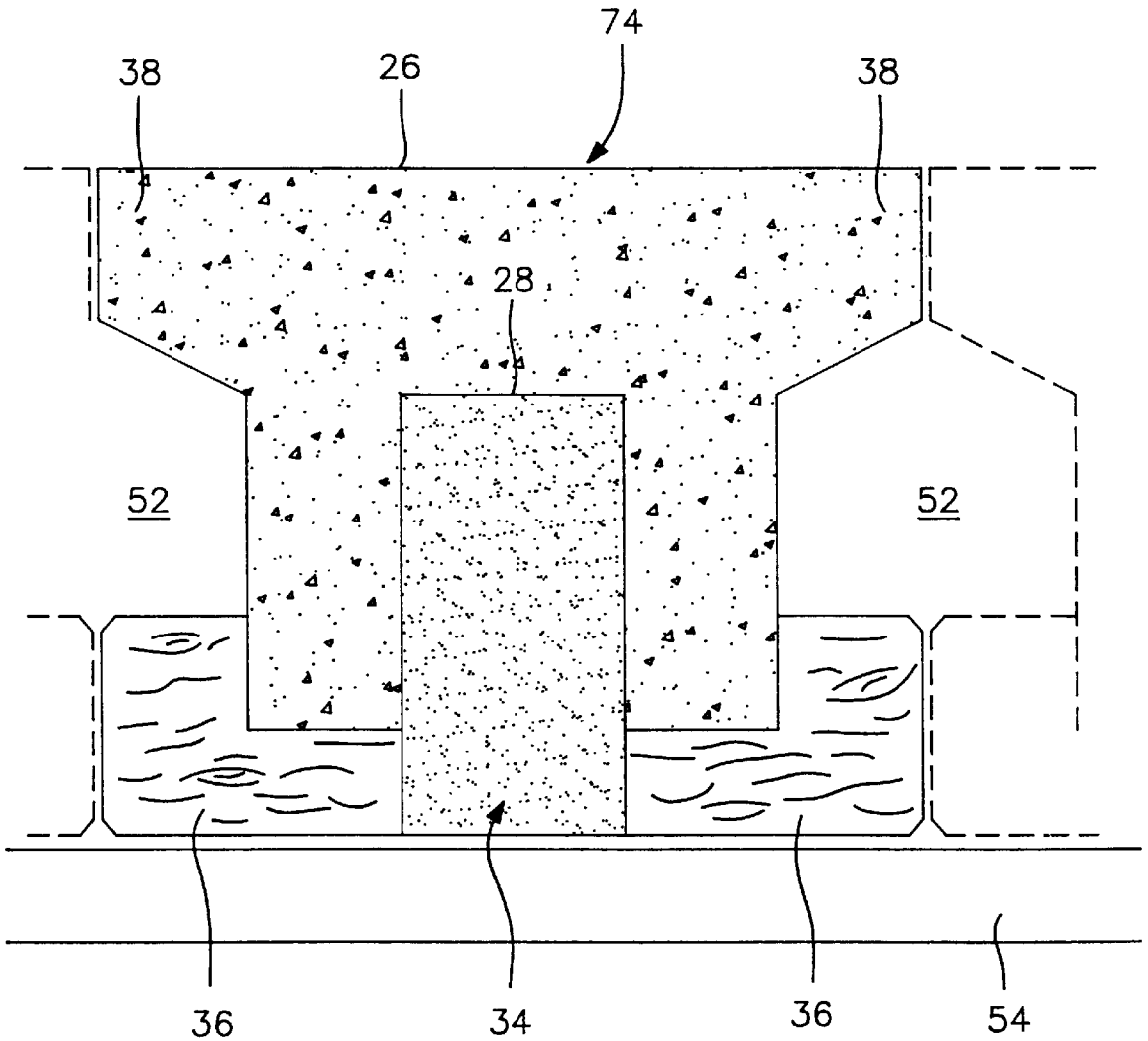
FIG. 11 is a top view of a spacer wall component in accordance with the present invention.

FIG. 11 illustrates a top view of a spacer wall component, generally designated by the reference numeral 74. Like the wall panels, the spacer wall component 74 has a flat outside face 26 with longitudinal edges 38, and a recessed inside face 28 which receives batt 34. The width of the frame is reduced, however, to enable the spacer wall component to be used to complete spaces in the wall system where there is insufficient space for the standard wall panel.

In accordance with a preferred method of construction, the exact location of each panel is determined at the outset and the vertical rebar is set in the foundation at the requisite spaced locations in the keys of adjoining panels. To construct the walls, the corner components are set first, with wall panels being added in sequence, moving toward the center of each wall. Each panel is set in the recessed area created in the foundation by the framing boards and plumbed with wall braces. The mortar is then poured into the keys; once the mortar has hardened, the wall braces are removed.

The wall panels of the present invention are suitable for the construction of exterior walls of houses and all sorts of other buildings. The outside surface, embodied as the flat outside face 26, is preferably plain concrete with a floating texture. Other textures are of course possible. The inside finish of the wall is independent of the panel and is formed, preferably with a vapor barrier, and with any type of drywall, both of which are fastened to the wood moldings.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A precast concrete wall panel comprising:

a rectangular concrete frame having an outside face, a recessed inside face, two side faces and a footer, the recessed inside face including a plurality of ribs for structural reinforcement;

an insulation batt embedded in the frame on the recessed inside face, the batt having on an inner surface channels corresponding to the plurality of ribs and substantially covering the ribs; and strips of wood molding secured along longitudinal outside edges of the recessed inside face;

said outside face having longitudinal edges which extend laterally so as to be approximately flush with the strips of wood molding to form an outward-facing recess along each of said two side faces, each said outward-facing recess defined on a first side by a concrete longitudinal edge of the outside face and on a second side by one edge strip of wood molding on the recessed inside face, the concrete longitudinal edge and the wood molding edge strip are adapted to abut a corresponding concrete longitudinal edge and wood molding edge strip on an adjacent frame to form a channel for filling with concrete.

2. The concrete wall panel as set forth in claim 1 wherein each side face of the footer includes a vertically extending recess that is in vertical alignment with the recess formed in a respective side face of said frame.

3. The concrete wall panel as set forth in claim 1 wherein concrete used to cast the concrete frame is reinforced with polypropylene fibers.

4. The concrete wall panel as set forth in claim 1 wherein the insulation batt is made of mineral wool and serves as an inside mold when pouring concrete to form the panel.

5. A precast concrete wall panel system comprising:

a plurality of precast concrete wall panels, each of said plurality of precast concrete wall panels including, a rectangular concrete frame having an outside face, a recessed inside face, two side faces and a footer, the recessed inside face including a plurality of ribs for structural reinforcement;

an insulation batt embedded in the frame on the recessed inside face, the batt having on an inner surface channels corresponding to the plurality of ribs and serving as an inside mold when pouring concrete to form said panel; and strips of wood molding secured along longitudinal outside edges of the recessed inside face;

said outside face having longitudinal edges which extend laterally so as to be approximately flush with the strips of wood molding to form an outward-facing recess along each of said two side faces, each outward-facing recess defined on a first side by a concrete longitudinal edge of the outside face and on a second side by one edge strip of wood molding on the recessed inside face;

said plurality of panels being placed side by side along a building foundation having reinforcement rods extending upward therefrom such that the concrete longitudinal edges of the outside face of adjacent panels abut, and the edge strips of wood molding of adjacent panels abut, whereby corresponding outward-facing recesses of adjacent side faces form a channel through which a respective reinforcement rod extends upwardly, said channel being poured with concrete to secure the panels to the building foundation and to each other, creating a solid wall from interior to exterior.

6. The precast concrete wall panel system as set forth in claim 5 wherein dry wall is fastened to said strips of wood molding to create a finished inner wall surface.

7. The precast concrete wall panel system as set forth in claim 5 further comprising:

a corner panel constructed of precast concrete and having a depth and a width corresponding to a depth of the wall panels, and a height corresponding to a height of the wall panels, the corner panel having a centrally located longitudinal channel running the height of the corner panel and having, along one longitudinal edge, a strip of wood molding, said longitudinal channel encircling a vertical reinforcement rod extending from the building foundation and being poured with concrete to secure the corner panel to the foundation, said corner panel abutting two wall panels, one strip of wood molding of each abutting wall panel touching the wood molding of the corner panel and a corresponding longitudinal edge of the outside face of each abutting wall panel touching a wall surface of the corner panel such that a channel is formed between each of the two abutting wall panels and the corner panel into which concrete is poured to secure the corner panel to the two abutting wall panels, the resulting wall and corner structure being solid from interior to exterior.

8. The precast concrete wall panel system as set forth in claim 5, further comprising:

a corner panel constructed of precast concrete and having a depth and a width corresponding to a depth of the wall panels, and a height corresponding to a height of the wall panels, the corner panel having a centrally located longitudinal channel running the height of the corner panel and having, along one longitudinal edge, a strip of wood molding, said longitudinal channel encircling a vertical reinforcement rod extending from the building foundation and being poured with concrete to secure the corner panel to the foundation, wherein the corner panel abuts two wall panels, one strip of wood molding and a corresponding longitudinal edge of each abutting wall panel touching a wall surface of the corner panel such that a channel is formed between each of the two abutting wall panels and the corner panel into which concrete is poured to secure the corner panel to the two abutting wall panels, the resulting wall and corner structure being solid from interior to exterior.

9. The precast concrete wall panel system as set forth in claim 8 wherein dry wall is fastened to said strip of wood molding on the corner panel to create a finished inner wall corner surface.

10. A precast concrete wall panel system comprising:

a plurality of concrete wall panels, each panel including a rectangular concrete frame having an outside face, an inside face, and two side faces;

strips of wood molding secured only along longitudinal outside edges of the inside face of each panel, each strip of wood molding having an exposed side face and an exposed front face;

said outside face of each panel having longitudinal edges which extend laterally so as to be approximately flush with the exposed side faces of the strips of wood molding to form for each frame an outward-facing recess along each of said two frame side faces;

an insulation batt embedded in each frame on the inside face, an outward facing surface of the batt being approximately flush with the exposed front faces of the strips of wood molding of said frame;

said plurality of concrete wall panels being placed side by side along a building foundation having reinforcement rods extending upward therefrom such that the longitudinal edges of the outside faces of adjacent panels abut, and the exposed side faces of the strips of wood molding of adjacent panels abut, whereby corresponding outward-facing recesses of adjacent frame side faces form a channel through which a respective reinforcement rod extends upwardly, said channel being poured with concrete to secure the panels to the building foundation and to each other, creating a wall that is solid from interior to exterior; and drywall being fastened to the exposed front faces of the strips of wood molding to create a finished inner wall surface.

* * * * *